US010400362B2

(12) United States Patent
Pilar

(10) Patent No.: US 10,400,362 B2
(45) Date of Patent: Sep. 3, 2019

(54) METHOD FOR DEPOSITING A YARN END ON A BOBBIN IN A DEFINED MANNER, A DEVICE AND A SPINNING AND WINDING MACHINE FOR PERFORMING THE METHOD

(71) Applicant: Maschinenfabrik Rieter AG, Winterthur OT (CH)

(72) Inventor: Evzen Pilar, Litomysl (CZ)

(73) Assignee: Maschinenfabrik Rieter AG, Winterhur (CH)

( * ) Notice: Subject to any disclaimer, the term of this patent is extended or adjusted under 35 U.S.C. 154(b) by 0 days.

(21) Appl. No.: 15/811,768

(22) Filed: Nov. 14, 2017

(65) Prior Publication Data

US 2018/0135209 A1 May 17, 2018

(30) Foreign Application Priority Data

Nov. 14, 2016 (CZ) ..... 2016-707

(51) Int. Cl.

| | |
|---|---|
| ***B65H 54/28*** | (2006.01) |
| ***B65H 54/34*** | (2006.01) |
| ***D01H 13/04*** | (2006.01) |
| ***D01H 13/16*** | (2006.01) |
| ***D01H 13/26*** | (2006.01) |

(52) U.S. Cl.

CPC ..... *D01H 13/045* (2013.01); *B65H 54/28* (2013.01); *B65H 54/346* (2013.01); *D01H 13/16* (2013.01); *D01H 13/26* (2013.01); *B65H 2701/31* (2013.01); *B65H 2701/311* (2013.01)

(58) Field of Classification Search

CPC ..... B65H 54/346

See application file for complete search history.

(56) References Cited

U.S. PATENT DOCUMENTS

| | | | |
|---|---|---|---|
| 4,891,933 | A | 1/1990 | Raasch |
| 4,948,057 | A | 8/1990 | Greis |
| 5,330,115 | A | 7/1994 | Mayer et al. |
| 5,681,000 | A | 10/1997 | Gobbels et al. |
| 6,045,081 | A | 4/2000 | Oberstrass et al. |

(Continued)

FOREIGN PATENT DOCUMENTS

| | | | |
|---|---|---|---|
| CZ | 284 219 B6 | 4/1993 | |
| EP | 0 927 695 A2 | 7/1999 | |
| EP | 1125879 A2 * | 8/2001 | ..... B65H 54/2827 |

OTHER PUBLICATIONS

Machine Translation of EP 1 125 879, Aug. 22, 2001. (Year: 2001).*

(Continued)

*Primary Examiner* — William E Dondero

(74) *Attorney, Agent, or Firm* — Dority & Manning, P.A.

(57) ABSTRACT

A method for depositing a yarn end on a bobbin wound on a tube in a defined manner during winding of yarn on the bobbin at a workstation of a spinning and winding machine includes terminating spinning production of the yarn at the workstation to create a yarn end. The yarn end is then prepared with working devices at the workstation, including rotating the bobbin in a direction opposite to a winding direction during production of the yarn. A yarn reserve is formed, and the yarn end is then deposited in a defined manner on the tube outside of the profile of a standard yarn package.

11 Claims, 1 Drawing Sheet

(56) References Cited

U.S. PATENT DOCUMENTS

| | | | | |
|---|---|---|---|---|
| 6,241,177 | B1 | 6/2001 | Schroter et al. | |
| 6,505,791 | B1 | 1/2003 | Syndikus et al. | |
| 2002/0023422 | A1 | 2/2002 | Stephan et al. | |
| 2007/0175199 | A1* | 8/2007 | Badiali ..... | B65H 54/26 57/22 |
| 2008/0283655 | A1 | 11/2008 | Henze et al. | |

OTHER PUBLICATIONS

EPO Search Report, dated Mar. 12, 2018.
CZ Search Report, dated Aug. 1, 2017.

* cited by examiner

METHOD FOR DEPOSITING A YARN END ON A BOBBIN IN A DEFINED MANNER, A DEVICE AND A SPINNING AND WINDING MACHINE FOR PERFORMING THE METHOD

TECHNICAL FIELD

The invention relates to a method for depositing a yarn end on a bobbin in a defined manner during winding yarn on a bobbin at a workstation of a spinning and winding machine after the required length of yarn has been wound on the bobbin, in which the yarn end is deposited on a tube in a defined manner outside the profile of a standard yarn package.

The invention also relates to a device for depositing a yarn end on a bobbin in a defined manner during winding yarn on a bobbin at a workstation of a spinning and winding machine, which comprises a yarn guide of a traversing device of yarn, mounted so as to be movable reciprocatingly along the width of the bobbin, the yarn guide reciprocatingly movable in a controlled manner to an area outside of the profile P of the standard yarn package on the bobbin.

The invention further relates to a spinning and winding machine comprising a row of workstations arranged next to each other, wherein each workstation comprises a winding device of yarn before which is arranged a traversing device of yarn comprising a reciprocating traversing guide of yarn movable along the width of the bobbin, the yarn guide reciprocatingly movable in a controlled manner to an area outside of the profile P of the standard yarn package on the bobbin.

BACKGROUND

Depositing a yarn end on a bobbin in a defined manner after terminating the winding process is one of the conditions for the subsequent processing of the yarn wound on the bobbin, particularly from the point of view of finding easily the yarn end on the bobbin for further yarn processing. As a matter of fact, when winding is being terminated on the respective bobbin, several last windings of the yarn are wound on the tube of the bobbin being wound immediately next to the standard package at the end of the bobbin. The end portion of the yarn with the yarn end is deposited by winding from the edge of the standard yarn package obliquely towards the other end of the standard package directly across the surface of the standard package.

Numerous methods and devices are known to perform this. Nevertheless, their common disadvantage is the complexity of the design and the need for special design of the elements, e. g., by means of an attending device which is movable along a row of workstations.

It is therefore an aim of the invention to eliminate or at least minimize the drawbacks of the background art, especially to allow depositing the yarn end on a bobbin in a defined manner by using simple means, and preferably, by using the means of a workstation of a spinning and winding machine or by using the existing means of the workstation to the maximum possible extent.

SUMMARY OF THE INVENTION

An aim of the invention is achieved by a method for depositing a yarn end on a bobbin in a defined manner, whose principle consists in that spinning production of the yarn is terminated and the yarn end is prepared for being deposited on a tube outside the profile of a standard yarn package by the means of a workstation, including formation of a yarn reserve.

The advantage of this solution is optimal use of the existing means of a workstation of a spinning and winding machine, whether it is an air jet spinning machine or a rotor spinning machine, or a winding machine, etc.

Additional objects and advantages of the invention will be set forth in part in the following description, or may be obvious from the description, or may be learned through practice of the invention.

The principle of the device for depositing a yarn end on a bobbin in a defined manner during winding yarn on a bobbin at a workstation of a spinning and winding machine consists in that a yarn reserve is formed and the yarn guide is reciprocatingly movable in a controlled manner to the area outside the profile P of the standard package on the bobbin to deposit the yarn end from the yarn reserve.

The principle of the spinning and winding machine comprising a row of workstations arranged next to each other, wherein each workstation comprises a winding device of yarn before which is arranged a traversing device of yarn comprising a reciprocating traversing guide of yarn movable along the width of the bobbin, consists in that a yarn reserve is formed and the yarn guide is reciprocatingly movable in a controlled manner to the area outside the profile P of the standard package on the bobbin to deposit the yarn end from the yarn reserve.

DESCRIPTION OF DRAWINGS

The invention is schematically represented in the drawing, where.

DETAILED DESCRIPTION

Figure 1:
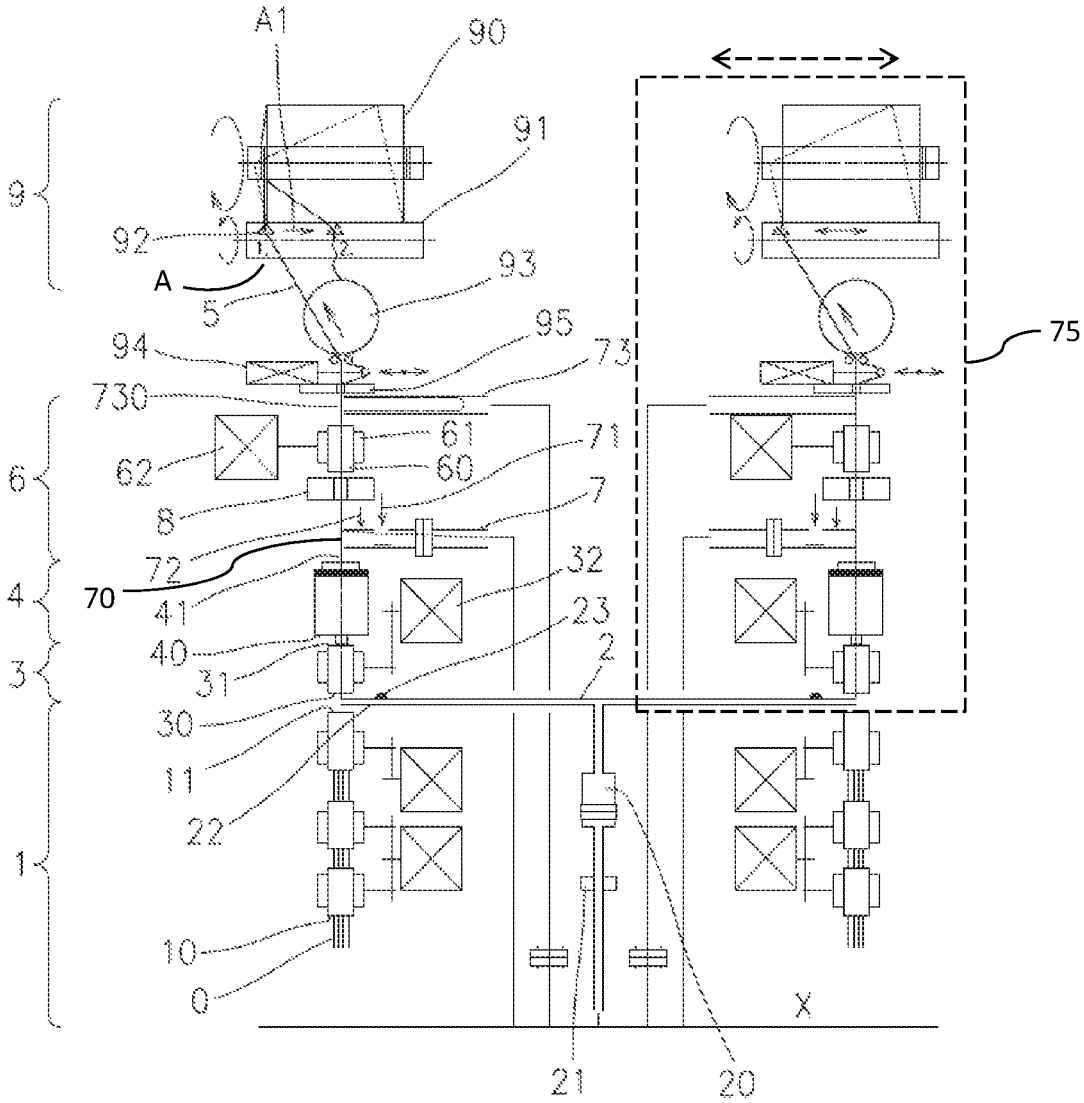
FIG. 1 shows a pair of workstations of an air-jet spinning machine, which are arranged next to each other.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

A spinning and winding machine comprises at least one row of adjacent workstations, each of which contains the same working means and nodes. Such a spinning and winding machine is, for example, an air jet spinning machine or a rotor spinning machine, or a winding machine, etc., which may have a different design in certain respects, but for the use of the present invention they are provided with corresponding working means.

The invention will be described in detail with reference to an exemplary embodiment of a workstation of a air-jet spinning machine and rotor spinning machine, which comprises at least one row of identical workstations arranged next to each other.

In the illustrated embodiment, pairs of adjacent workstations are shown, whereby the workstations in the specific embodiment share some of the elements, especially the elements used for resuming spinning at the workstation, which will be briefly described in the following. In the not illustrated embodiment, each workstation is provided with non-shared working means.

The illustrated embodiment of a workstation of an air jet spinning machine comprises a drafting mechanism 1 of sliver 0, which is by its inlet opening 10 aligned with an unillustrated source of sliver and which is by its outlet opening 11 aligned with the inlet opening 30 of a fiber feeding device 3.

The fiber feeding device 3 is coupled to a drive 32 and its outlet opening 31 is aligned with the inlet opening 40 for fibers to a spinning nozzle 4. In the spinning nozzle 4, the entering sliver 0 is transformed into yarn 5, which is drawn off from the nozzle 4 by a drawing-off mechanism 6 arranged behind the outlet opening 41 for the yarn 5 from the spinning nozzle 4.

An unillustrated embodiment of a workstation of a rotor spinning machine includes a feeding device of the fiber sliver which is the input part of the rotor spinning unit, in which a spinning rotor is situated, and fibres singled-out from the sliver are fed into the spinning rotor, in which they are formed into yarn 5. The yarn 5 is drawn-out by a drawing-off mechanism 6 arranged behind the outlet of yarn 5 from the rotor spinning unit.

The drawing-off mechanism 6 comprises a pair of rollers 60, 61, which are pressed to each other, one of which is coupled to a rotary drive 62 and the other being rotatably mounted on an unillustrated pressure arm, which is swingingly mounted in the workstation structure.

Between the outlet opening 41 of the spinning unit 4 and the drawing-off mechanism 6 of yarn 5, or in a rotor spinning machine between the outlet of yarn 5 from the rotor spinning unit and the drawing-off mechanism 6 of yarn 5, the working path of yarn 5 is aligned with a suction opening of a suction tube 7, which is connected in a controllable manner to a vacuum source X. A device 71 for interrupting the yarn 5 and a device 72 for passing the yarn 5 end to the nozzle 4, or to the spinning rotor, are arranged in the suction tube 7.

Between the suction tube 7 and the drawing-off mechanism 6 of yarn 5 is arranged a sensor 8 of the quality of yarn 5, which is connected to the control systems of the workstation and/or to the control systems of a section of the workstations and/or of the machine.

A winding device 9 of yarn 5 on the bobbin 90 is arranged in the path of yarn 5 downstream the yarn drawing-off mechanism 6. During winding, the bobbin 90 lies on a drive cylinder 91, which drives the bobbin 90 by rolling, the yarn 5 being traversed across the width of the bobbin 90 by a guide 92 of a yarn traversing device. In the illustrated embodiment, before the traverse guide 92, the yarn passes through a waxing device 93. In the case of conical bobbins being wound, upstream the waxing device is in the yarn 5 path arranged a compensator 94 of yarn loops which arise periodically during winding the yarn on the conical bobbins 90. In the yarn 5 path before the compensator 94 is arranged a sensor 95 of the yarn 5 presence, which operates in the mode of a yarn break detector during the yarn production.

Between the sensor 95 of the yarn 5 presence and the yarn drawing-off mechanism 6 a vacuum reservoir of yarn 73 is assigned with its suction inlet opening 730 towards the yarn 5 path, the vacuum reservoir of yarn 73 being connected to the vacuum source X.

In the illustrated embodiment for resuming spinning at a workstation of an air-jet spinning machine, the mouth 22 of a guide channel 2 of yarn 5 is arrangeable in the space between the outlet opening 11 of the drafting mechanism 1 and the inlet opening 30 of the feeding device 3, whereby the mouth 22 is, during the normal spinning operation, either completely moved outside the space between the outlet opening 11 of the drafting mechanism 1 and the inlet opening 30 of the feeding device 3, or it is rigid and is situated outside the path of the sliver 0. The guide channel 2 is, by its other end, connected to the vacuum source X. The guide channel 2 is at a distance from its mouth 22 provided with a device 20 for the preparation of the spinning-in end of yarn. In the direction away from the mouth 22 of the auxiliary guide tube 2 downstream of the device 20, the guide channel 2 is provided with a sensor 21 of the yarn 5 presence in the guide channel 2.

In the illustrated embodiment of an air jet spinning machine, a securing element 23 (keeper) of the free yarn 5 end is arranged in the space between the inlet opening 30 of the feeding device 3 and the device 20, or between the inlet opening 40 of the spinning nozzle 4 and the device 20. In the illustrated embodiment, the securing element 23 (keeper) of the free yarn 5 end is part of the mouth 22 of the guide channel 2.

In an unillustrated embodiment of a Workstation of an air jet spinning machine or rotor spinning machine or other suitable spinning and winding machine for using of this invention, a device for detecting the yarn 5 end on the bobbin 90 is assignable to the surface of the yarn 5 package on the bobbin 90, which is during winding situated on a drive shaft 91, whereby this device for detecting the yarn 5 end is reversibly mounted either at each workstation or it is mounted at one workstation and is adapted to attend at least one immediately neighbouring workstation, etc. In another unillustrated example of embodiment of a workstation of both an air jet spinning machine and a rotor spinning machine or another suitable spinning and winding machine on which the present invention is to be realized, this device for detecting the yarn 5 end on the bobbin 90 is also a means for transferring the yarn 5 from the bobbin 90 to the outlet opening of the spinning unit, whether the spinning unit comprises a spinning rotor or spinning nozzle 4, etc., where the yarn 5 is ready to resume spinning.

The invention works in such a manner that the yarn 5 being produced is wound on the bobbin 90, whereupon after the required length of the yarn 5 is completely wound on the bobbin 90, the bobbin 90 is removed from the machine and sent off for further processing.

Since it is essential for the yarn 5 end to be detected relatively easily on this wound bobbin 90 when further processing is started, a defined reserve of yarn 5 is formed before the complete termination of winding the yarn 5 being produced on the bobbin 90, the yarn 5 reserve being deposited on the tube of the bobbin 90 outside the profile P of the standard (main) package. This is always performed on the same side of the tube of the bobbin 90, when the yarn end is deposited at the defined position for further processing.

This process of depositing of the yarn 5 end on the bobbin 90 (a tube with a package) in a defined manner is performed according to the invention in such a manner that the start for depositing the yarn 5 end on the bobbin 90 is determined by giving a signal to terminate the spinning operation at the respective workstation. In principal, there are two methods of how to terminate spinning at a workstation of conventional spinning and winding machines.

The first method for terminating the spinning operation is a method in which the yarn 5, after stopping spinning remains in its working path at the respective workstation and from then on it can be attended solely by the means of the workstation, which are used during spinning, which is the so-called controlled termination of spinning. At this defined position at the workstation the yarn 5 is prepared for the subsequent steps of depositing the yarn 5 end on the tube of the bobbin 90 in a defined manner outside the profile P of the standard (main) package.

The second method for terminating the spinning operation is a method in which the yarn 5 end is wound on the bobbin 90, and therefore at first the yarn 5 end must be detected on the bobbin 90 also in this case solely by the means of the workstation, e.g., by the above-mentioned device for detecting the yarn end and for transferring the yarn 5 at the workstation. In addition, the result of this process of detecting the yarn 5 end on the bobbin 90 is the fact that the yarn 5 is guided by the detecting and transferring device to the defined position at the workstation. As a result, the yarn is prepared for the subsequent steps of depositing the yarn 5 end in a defined manner on the tube of the bobbin 90 outside the profile P of the standard (main) package.

Taking into account the state of the art, it is also possible to determine in advance when the yarn 5, after controlled stopping, will stop on the working path at the workstation and when it is necessary to detect the yarn 5 end on the bobbin 90.

Prior to the actual start of depositing the yarn 5 end on the tube of the bobbin 90 in a defined manner outside the profile P of the standard (main) package, a sufficiently long reserve of yarn 5 is formed for depositing the yarn 5 end on the bobbin 90 in a defined manner outside the profile P of the standard package.

Formation of this yarn 5 reserve is performed either already during the controlled stopping of the workstation with the yarn being situated in its working path, or it is performed partially during the controlled stopping of the workstation and partially after the controlled stopping of the workstation, or it is carried out only after the workstation has been stopped.

The yarn 5 reserve for depositing the yarn 5 end on the bobbin 90 in a defined manner is deposited in a suitable reservoir of yarn 5 or simultaneously in several reservoirs of yarn 5, as will be described in greater detail in the following.

The yarn 5 reserve formation is preferably performed by sucking the yarn 5 reserve into the vacuum reservoir 73 of yarn 5 and/or by placing the yarn 5 reserve in the compensator 94 of yarn 5 loops, since the vacuum reservoir 73 of yarn and the compensator 94 of yarn 5 loops are situated directly at the workstation in the direction of the movement of yarn 5 during spinning and during the controlled stopping procedure only behind the yarn drawing-off mechanism 6, and so the winding device 9 can stop at full speed and can decelerate the spinning process in the nozzle 4 or in the spinning rotor according to the requirements of the textile technology, whereby the yarn 5 formed at a speed higher than the decreasing winding speed is gradually deposited at the respective workstation in the form of a reserve in the respective reservoir or in reservoirs. During depositing the yarn 5 in the respective reservoir or reservoirs, the yarn loop compensator 94 is either connected to control the yarn 5 tension or disconnected, according to the needs of the textile technology.

The yarn 5 reserve formation for depositing the yarn 5 end on the bobbin in a defined manner after the controlled stopping of the workstation, when the yarn 5 end is situated in the working path of the yarn 5 at the workstation, is preferably performed by sucking the yarn 5 into the suction tube 7, which is situated in the direction away from the winding device 9 below the yarn drawing-off mechanism 6, whereby the actual process of the yarn 5 reserve formation is carried out by unwinding the yarn 5 from the bobbin 90 by means of reverse rotation of the bobbin 90 in the winding device 9 and by means of reverse rotation of the drawing-off mechanism 6, through which the yarn 5 constantly passes and by which the yarn 5 is drawn off in the reverse manner from the bobbin 90, i.e., it is carried out while the winding device 9 and the drawing-off mechanism 6 rotate against the direction in which they rotate during continuous spinning, i.e., during normal production of yarn 5. During the unwinding of the yarn 5 from the bobbin 90, the yarn is according to the requirements acted upon by the compensator 94 of yarn 5 loops, which regulates in case of need possible fluctuations of yarn 5 tension, thereby improving unwinding the yarn 5 for the purpose of the yarn 5 reserve formation. Optionally, the yarn 5 reserve is formed in the vacuum reservoir 73 analogically to the above-mentioned process.

The yarn 5 reserve formation, partially before and partially only after the controlled procedure of stopping the workstation, is preferably performed by using a combination of the above-mentioned processes.

If the yarn 5 end 50, during the stopping procedure of the yarn 5 production at the workstation, gets out of the yarn drawing-off mechanism 6 or it is even wound on the bobbin 90, this being detected in both cases by the sensor 95 above the yarn drawing-off mechanism 6, the yarn 5 end is found either by the abovementioned means of the workstation or manually, whether it is on the bobbin 90 or in a part of the working path at the workstation. After the yarn 5 end detection, the yarn 5 is either guided back to its working path at the workstation between the winding device 9 and the drawing-off mechanism 6 and is inserted between drawing-off rollers 60, 61 of the winding device 6 or it is directly passed to the attending device, which is movable along the row of the workstations of the machine. In another embodiment, the detected yarn 5 is guided to its working path at the workstation between the winding device 9 and the drawing-off mechanism 6, from where it is subsequently taken over by the attending device, which is movable along the row of the workstations of the machine. In any case, after that the process of the yarn 5 reserve formation is started in the same manner as according to the preceding paragraph, i.e., by unwinding the yarn 5 from the bobbin 90 with the support of the yarn drawing-off mechanism 6 either to at least one reservoir at the workstation or to at least one reservoir on the attending device.

In an unillustrated embodiment, the yarn 5 reserve is formed by the means of the attending device, e.g., by a suitable vacuum reservoir, this taking place either during the procedure of stopping, or after stopping the workstation or partially during the stopping procedure and partially only after stopping the workstation.

After the formation of the yarn 5 reserve the yarn 5 is prepared for depositing the yarn 5 end on the bobbin 90 in a defined manner, whereby the yarn 5 is prepared either in the means of the workstation, or it is prepared in the means of the attending device 75 (depicted schematically by the dashed-line representation in FIG. 1).

Figure 2:
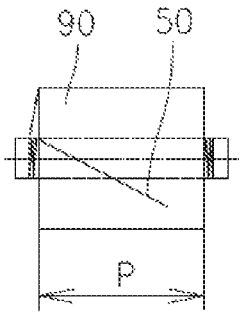
FIG. 2 shows the yarn end deposited on a bobbin in a defined manner.

If the yarn 5 is prepared in the means of the workstation, it then passes through the yarn guide 92 of the traversing device across the bobbin 90 width, or the yarn 5 is situated in a path which intersects the working path of the yarn guide 92 of the traversing device across the bobbin 90 width. Subsequently starts the actual process of depositing the yarn 5 end on the bobbin 90 in a defined manner outside the profile P of the standard package, which consists in that the winding device starts to rotate in the same direction as during winding in the standard production of yarn 5 and the yarn 5 guide 92 of the yarn traversing device moves aside outside the profile P of the standard yarn 5 package on the bobbin 90, as indicated in FIG. 1 by position A of the guide 92. Thus, at the same time, the yarn 5 reserve, which has been deposited in the respective reservoir or reservoirs at the workstation, starts to be consumed. As a result of the bobbin 90 rotation and the shift of the yarn 5 guide here, i.e., outside the profile P of the standard yarn 5 package on the bobbin 90, either all the yarn 5 reserve or the substantial part of the yarn reserve is wound. If it is required that the yarn 5 end itself is deposited onto the surface of the standard yarn 5 package on the bobbin 90, then at a defined moment, e.g., as soon as the yarn 5 end from the formed reserve of yarn 5 passes through the sensor 95 of the yarn 5 presence on the attending device, the yarn guide 92 of the traversing device moves across the width of the bobbin 90 in the direction A1 towards the opposite end of the bobbin 90, by which means the end portion of the yarn 5 and the yarn 5 end is fluently deposited onto the surface of the standard yarn 5 package in the direction towards the opposite end of the package on the bobbin 90, as is seen in FIG. 2. Since the bobbin 90 keeps rotating, the end portion of the yarn 5 and the yarn 5 end itself is deposited onto the surface of the standard package on the bobbin 90 obliquely to the longitudinal axis of the bobbin 90. The start of the final movement of the yarn guide 92 of the traversing device across the width of the bobbin 90 depends on the speed of the bobbin 90 rotation, i.e., the speed of the winding device 9 and on the geometrical arrangement of a system made up of the winding device 9, the yarn guide 92 and the yarn sensor 95, which determines the function of the speed and of the duration of the movement of the yarn 5 end 50 from the yarn sensor 95 to the guide 92.

In an equivalent manner, depositing the yarn 5 end on the bobbin 90 in a defined manner outside the profile P of the standard package is performed if the yarn 5 is prepared in the means of the attending device, which is provided with a suitable means for traversing the yarn 5 in a defined manner and with suitable yarn guide means. Also during this process, the winding device starts to rotate in the same direction as during the winding process in the standard production of yarn 5 and the yarn guide of the attending device moves aside, outside the profile P of the standard yarn 5 package on the bobbin 90. Thus, at the same time, the yarn 5 reserve, which has been deposited in the respective reservoir or reservoirs on the attending device, starts to be consumed. As a result of the bobbin 90 rotation and the shift of the yarn 5 guide here, i.e., outside the profile P of the standard yarn 5 package on the bobbin 90, either all the yarn 5 reserve or the substantial part of the yarn reserve is wound. If it is required that the yarn 5 end itself is deposited onto the surface of the standard yarn 5 package on the bobbin 90, then at a defined moment, e.g., as soon as the yarn 5 end from the formed reserve of yarn 5 passes through the yarn sensor 95, the yarn guide 92 on the attending device moves across the width of the bobbin 90 in the direction A1 towards the opposite end of the bobbin 90, by which means the end portion of yarn 5 and the yarn 5 end are fluently deposited on the surface of the standard yarn 5 package towards the opposite end of the package on the bobbin 90. Since the bobbin 90 keeps rotating, the end portion of the yarn 5 and the yarn 5 end is deposited on the surface of the standard package on the bobbin 90 obliquely with respect to the longitudinal axis of the bobbin 90. The start of the final movement of the yarn guide 92 on the attending device 5 depends on the speed of the bobbin 90 rotation, i.e., on the speed of the winding device 9 and on the geometrical arrangement of the system made up of the winding device 9, the yarn guide 92 and the yarn sensor 95, which determines the function of the speed and of the duration of the movement of the yarn 5 end 50 from the yarn sensor 95 to the guide 92.

Owing to the fact that the place where the yarn 5 is deposited on the bobbin 90 outside the profile P of the standard package has a considerably smaller diameter than the diameter of the standard package on the bobbin 90, it may happen due to the geometry of the winding device that the yarn 5 does not intersect the path of the yarn guide 92 of the traversing device across the width of the bobbin 90, and, consequently, the yarn guide 92 of the traversing device cannot capture the yarn 5 for depositing the end 50 of yarn 5 on the bobbin 90 in a defined manner outside the profile P of the standard package. To solve this situation, a rectifying means of the yarn path is mounted at the workstation or on the attending device to enable the yarn 5 to intersect the path of the yarn guide 92 of the traversing device of yarn 5 across the width of the bobbin 90 so that the guide 92 of yarn 5 of the traversing device of yarn 5 can deposit the end 50 of yarn 5 in a defined manner on the bobbin 90 outside the profile P of the standard package. In another unillustrated embodiment, the above-mentioned rectifying means is such that it enables to maintain/lock the yarn 5 in the yarn guide 92 of the traversing device during depositing the yarn 5 end on the bobbin 90 in a defined manner outside the profile P of the standard package.

Furthermore, it is advantageous for each of the above-mentioned variants if during depositing the yarn 5 on the tube of the bobbin 90 outside the profile P of the standard yarn 5 package, the yarn 5 is acted upon by the compensator of yarn 5 loops and/or by air suction and/or by the yarn drawing-off mechanism from the spinning unit and/or by a yarn braking device, by which means it is possible to maintain the tension of the yarn 5 when being deposited on the tube (on the bobbin 90) outside the profile P of the standard yarn 5 package.

Modifications and variations can be made to the embodiments illustrated or described herein without departing from the scope and spirit of the invention as set forth in the appended claims.

The invention claimed is:

1. A method for depositing a yarn end on a bobbin wound on a tube in a defined manner during winding of yarn on the bobbin at a workstation of a spinning and winding machine, the method comprising:

terminating spinning production of the yarn at the workstation to create a yarn end;

preparing the yarn end with working devices of the workstation, including rotating the bobbin in a direction opposite to a winding direction during production of the yarn;

forming a yarn reserve; and subsequently depositing the yarn end in a defined manner on the tube outside of a profile of a standard yarn package.

2. The method according to claim 1, wherein the yarn is prepared by detecting the yarn end on the bobbin with the working devices of the workstation.

3. The method according to claim 1, wherein after the preparation of the yarn end, the yarn is taken over from the workstation by an attending device that is movable along a row of the workstations, wherein the yarn reserve is subsequently gradually consumed from the attending device by being wound on the tube outside the profile of the standard yarn package.

4. The method according to claim 1, wherein after the preparation of the yarn end, the yarn reserve is subsequently gradually consumed by the working devices of the workstation by being wound on the tube outside the profile of the standard yarn package.

5. The method according to claim 1, wherein the yarn reserve is formed during the preparation of the yarn end.

6. The method according to claim 1, wherein the yarn reserve is formed only after the preparation of the yarn end.

7. The method according to claim 1, wherein the yarn reserve is formed partially during the preparation of the yarn end and partially after the preparation of the yarn end.

8. The method according to claim 1, wherein the yarn end is deposited from the yarn reserve by the workstation or by an attending device that is movable along a row of the workstations.

9. The method according to claim 8, wherein during depositing the yarn end, the yarn is acted upon by one or more of a yarn loop compensator, an air suction device, a yarn drawing-off mechanism, or a yarn braking device, by which yarn tension is maintained during depositing the yarn on the tube outside the profile of the standard yarn package.

10. The method according to claim 1, wherein after depositing the yarn end on the tube outside the profile of the standard yarn package, the yarn end is deposited onto the surface of the standard yarn package on the bobbin by movement of a yarn guide in a direction towards an opposite end of the bobbin.

11. The method according to claim 10, wherein one or both of termination of depositing the yarn on the tube outside the profile of the standard yarn package or start of the movement of the yarn guide in the direction towards the opposite end of the bobbin is initiated by passage of the yarn end through a yarn presence sensor.

* * * * *